US006030233A

United States Patent [19]

Kamiyamane

[11] Patent Number: 6,030,233

[45] Date of Patent: Feb. 29, 2000

[54] HOT PLUGGABLE CONNECTOR

[75] Inventor: Shin Kamiyamane, Tokyo, Japan

[73] Assignee: NEC Corporation, Tokyo, Japan

[21] Appl. No.: 09/128,742

[22] Filed: Aug. 4, 1998

[30] Foreign Application Priority Data

Aug. 5, 1997 [JP] Japan ..... 9-210450

[51] Int. Cl.[7] ..... H01R 9/09

[52] U.S. Cl. ..... 439/65; 200/51.09

[58] Field of Search ..... 439/49, 52, 65, 439/66; 200/51.12, 51.13, 51.08

[56] References Cited

U.S. PATENT DOCUMENTS

| | | | |
|---|---|---|---|
| 3,001,167 | 9/1961 | Chesnutt et al. | 200/51.13 |
| 3,636,499 | 1/1972 | Winklebleck | 439/65 |
| 4,549,076 | 10/1985 | Flies | 200/51.12 |
| 5,581,134 | 12/1996 | Romerein et al. | 200/51.08 |

FOREIGN PATENT DOCUMENTS

| | | |
|---|---|---|
| 57-104478 | 12/1955 | Japan . |
| 61-161979 | 10/1986 | Japan . |
| 63-133082 | 8/1988 | Japan . |

*Primary Examiner*—Steven L. Stephen
*Assistant Examiner*—J. F. Duverne
*Attorney, Agent, or Firm*—McGinn & Gibb, P.C.

[57] ABSTRACT

A hot pluggable connector of the invention accompanies no physical shock when a circuit package (9) is plugged or unplugged. When the circuit package (9) is inserted, board-side terminals (34) and package-side terminals (52) of the hot pluggable connector are not put in contact. By rotating a rotary body (32) having pads (33A to 33C) of different lengths, sequential connection/disconnection between the board-side terminals (34) and the package-side terminals (52) are performed by way of the pads (33A to 33C). Therefore, it is not necessary to plugging or unplugging the circuit package (9) within a time limit, enabling to insert or remove the circuit package (9) quietly. The timings of the sequential connection/disconnection can be arranged only by arranging length difference of the pads (33A to 33C), enabling to reduce production cost of the hot pluggable connector.

15 Claims, 8 Drawing Sheets

HOT PLUGGABLE CONNECTOR

BACKGROUND OF THE INVENTION

The present invention relates to a connector of an electronic circuit board incorporated in an electronic apparatus such as a computer, and more particularly to a hot pluggable connector which is a connector having terminals to be connected or disconnected sequentially designed for hot-line connection/disconnection.

Some examples of the hot-line connectors are disclosed in Japanese utility model applications laid open as Provisional Publications Nos. 133082/'88, 104478/'82, and 161979/'86.

For the hot-line connection/disconnection (hereafter called the hot plugging), it is required to prevent a power supply voltage variation or a signal disturbance on bus lines because of the hot plugging. For this purpose, in many conventional hot pluggable connectors, terminals provided on an electronic circuit package are designed to be connected sequentially with time differences, so that signal lines, a power supply line, a ground line and so on are connected or disconnected in a predetermined order. For such sequential connection/disconnection of the terminals, however, the electronic circuit package has to be inserted or pulled out within a time limit prescribed for the electronic apparatus in which the electronic circuit package is to be used, which means that the insertion or the pullout must be done very rapidly.

FIG. 8 is a sectional view illustrating an example of a conventional two-piece type hot pluggable connector, wherein a long terminal 11 having a longer contact piece and a short terminal 12 having a shorter contact piece are provided in a board-side connector 3 mounted on a circuit board 7. When a package-side connector 5 mounted on an circuit package 9 is to be engaged with the board-side connector 3, a package-side terminal 13 of the package-side connector 5 is first connected to the long terminal 11 of the board-side connector 3, and then another package-side terminal 14 of the package-side connector 5 is connected to the short terminal 12 of the board-side connector 3. Thus, the short terminal 12 is connected to the package-side terminal 14 after the long terminal 11 is connected to the package-side terminal 13 with a time difference according to a length difference between the long and short terminals 11 and 12.

FIG. 9 is a sectional view illustrating an example of a conventional one-piece type hot pluggable connector, wherein pads on a card-edge of an electronic circuit package 9 are connected to a card-edge connector, that is, a board-side connector 3 having board-side terminals 15 and 16. On the card-edge of the electronic circuit package 9, a long pad 95 and a short pat 96 are arranged at positions which are shifted with each other in the engaging direction, so that the short pad 96 is connected to the board-side terminal 16 sequentially after the long pad 95 is connected to the board-side terminal 15 when the card-edge is engaged with the card-edge connector 3, with a time difference proportional to the positional difference between the long and the short pad 95 and 96.

In the above mentioned Japanese utility model application of the Provisional Publication No. 161979/'86, connector terminals are formed in different shapes for realizing the sequential connection/disconnection. More particularly, a contact point is configured for each of the connector terminals by bending a part thereof, and the positions of the bending parts are so arranged to realize a desired order of the sequential connection/disconnection.

However, the conventional hot pluggable connectors such as above described have various disadvantages as will be described below.

First of all, a considerably large shock may be caused when the conventional hot pluggable connector is plugged or unplugged. This is because the time difference necessary for the sequential connection/disconnection of terminals is defined by length difference among the terminals in a direction parallel to the plug-in direction of the circuit package whereto the hot pluggable connector is provided. Therefore, the circuit package should be plugged or unplugged rapidly within a time limit according to performance and configuration of the electronic apparatus whereto the circuit package is applied, so as to prevent the supply voltage variation, the bus line signal disturbance or the element breakdown of the circuit package.

Secondly, it is required, because of the same reason, to reinforce anti-shock performance of the circuit board having the conventional hot pluggable connector whereto the circuit package is plugged in, or to provide an effective mechanism for preventing the neighboring packages loosing off from the electronic apparatus. Furthermore, when the plugging/unplugging time limit is more strict, a special tool may be needed for plugging or unplugging the circuit package, resulting in a high cost.

Thirdly, such quick plugging or unplugging of a circuit package may possibly cause damages in the wiring pattern of the circuit package and degrade the reliability of packaged elements. This disadvantage also comes from the above-mentioned reason that the time difference for the sequential connection/disconnection is defined by length difference of the terminals in the direction parallel to the plug-in direction.

Fourthly, the conventional hot pluggable connectors are more expensive compared to the ordinary connectors. This is because they use more parts than the ordinary connectors, including a plurality of terminals different in length or bent position with each other, prepared for the sequential connection/disconnection thereof.

Fifthly, when the terminal length once set for a sequential connection/disconnection has to be changed later, a new set of terminals having new terminal length must be prepared again for the new sequence. This is because the sequential connection/disconnection is defined by length difference of the terminals in the conventional hot pluggable connector.

SUMMARY OF THE PRESENT INVENTION

Therefore, a primary object of the present invention is to improve reliability of the hot pluggable connector by eliminating the physical shock accompanying plugging and unplugging of the hot pluggable connector.

Another object of the invention is to enable a more compact and lightweight electronic apparatus by reducing necessity of reinforcing mechanism of the electronic apparatus wherein the hot pluggable connector is applied.

Another object of the invention is to provide an inexpensive hot pluggable connector through high productivity enabled by realizing a single type hot pluggable connector applicable to a variety of connection/disconnection sequences of the terminals thereof according to users' needs.

Another object of the invention is to provide a hot pluggable connector wherein its connection/disconnection sequence can be easily changed according to change of the needs.

Still another object of the invention is to provide a hot pluggable connector which is easier-to-operate requiring but a little force for plugging and unplugging.

In order to achieve the object, in a hot pluggable connector of the invention having a combination of a board-side connector and a package-side connector to be connected to the board-side connector, the board-side connector comprises:

a board-side housing fixed to a circuit board;

a rotary body disposed inside the board-side housing, the rotary body having a circular cross-section and being able to rotate around an axis thereof;

a plurality of pads of a variety of lengths, each of the plurality of pads extending along circumference of the rotary body in parallel to each other in a rotating direction of the rotary body; and board-side terminals, each provided inside the board-side housing to be connected with corresponding each of the plurality of pads according to rotation of the rotary body; and the package-side connector comprises:

a package-side housing fixed to a circuit package and able to be engaged and disengaged with the board-side housing; and package-side terminals, each provided inside the package-side housing to be connected with corresponding each of the plurality of pads according to rotation of the rotary body when the package-side housing is engaged with the board-side housing.

In the above hot pluggable connector, the sequential connection/disconnection between the board-side terminals and the package-side terminals is realized by way of the plurality of pads according to rotary movement of the rotary body. Therefore, it is not necessary to plug or unplug the circuit package within a time limit, and hence, the shock accompanying the high-speed plugging or unplugging of the circuit package can be eliminated, which makes it unnecessary to provide reinforcing mechanism against such shocks to either the circuit board or the circuit package, and improves reliability of the circuit board by preventing damages to the wiring pattern and degradation of the circuit element thereof.

Furthermore, the connection/disconnection sequences can be optionally set by only arranging pad length of the rotary body. Therefore, the hot pluggable connector can be manufactured with a lower cost, than the conventional hot pluggable connector wherein the terminal length should be correspondingly changed, if the sequence of terminal connections has to be changed, resulting in a high manufacturing cost.

In another hot pluggable connector of the invention, the board-side connector comprises:

a board-side housing fixed to a circuit board;

at least two rotary bodies disposed inside the board-side housing, each of the rotary bodies being able to rotate around an axis thereof independently from each other, and having a cross-section, perpendicular to the axis, of a form other than a circle having a center where the axis intersects the cross-section;

a plurality of pads, each rounding circumference of one of the rotary bodies ranged in parallel to each other in a rotating direction of said one of the rotary bodies; and board-side terminals, each provided inside the board-side housing to be connected with corresponding each of the plurality of pads according to rotation of corresponding one of the rotary bodies; and the package-side connector comprises:

a package-side housing fixed to a circuit package and able to be engaged and disengaged with the board-side housing; and package-side terminals, each provided inside the package-side housing to be connected with corresponding each of the plurality of pads according to rotation of corresponding one of the rotary bodies when the package-side housing is engaged with the board-side housing.

Therefore, the circuit package can be inserted or removed with little force because of the rotary bodies which remain not in contact with terminals when the circuit package is inserted or removed, and even if there are many terminals to be connected, it can be connected with little force by providing necessary number of the rotary bodies to be turned one by one.

BRIEF DESCRIPTION OF THE DRAWINGS

The foregoing, further objects, features, and advantages of this invention will become apparent from a consideration of the following description, the appended claims, and the accompanying drawings wherein the same numerals indicate the same or the corresponding parts.

In the drawings.

DETAILED DESCRIPTION OF THE PREFERRED EMBODIMENTS

Now, embodiments of the present invention will be described in connection with the drawings.

Figure 1:
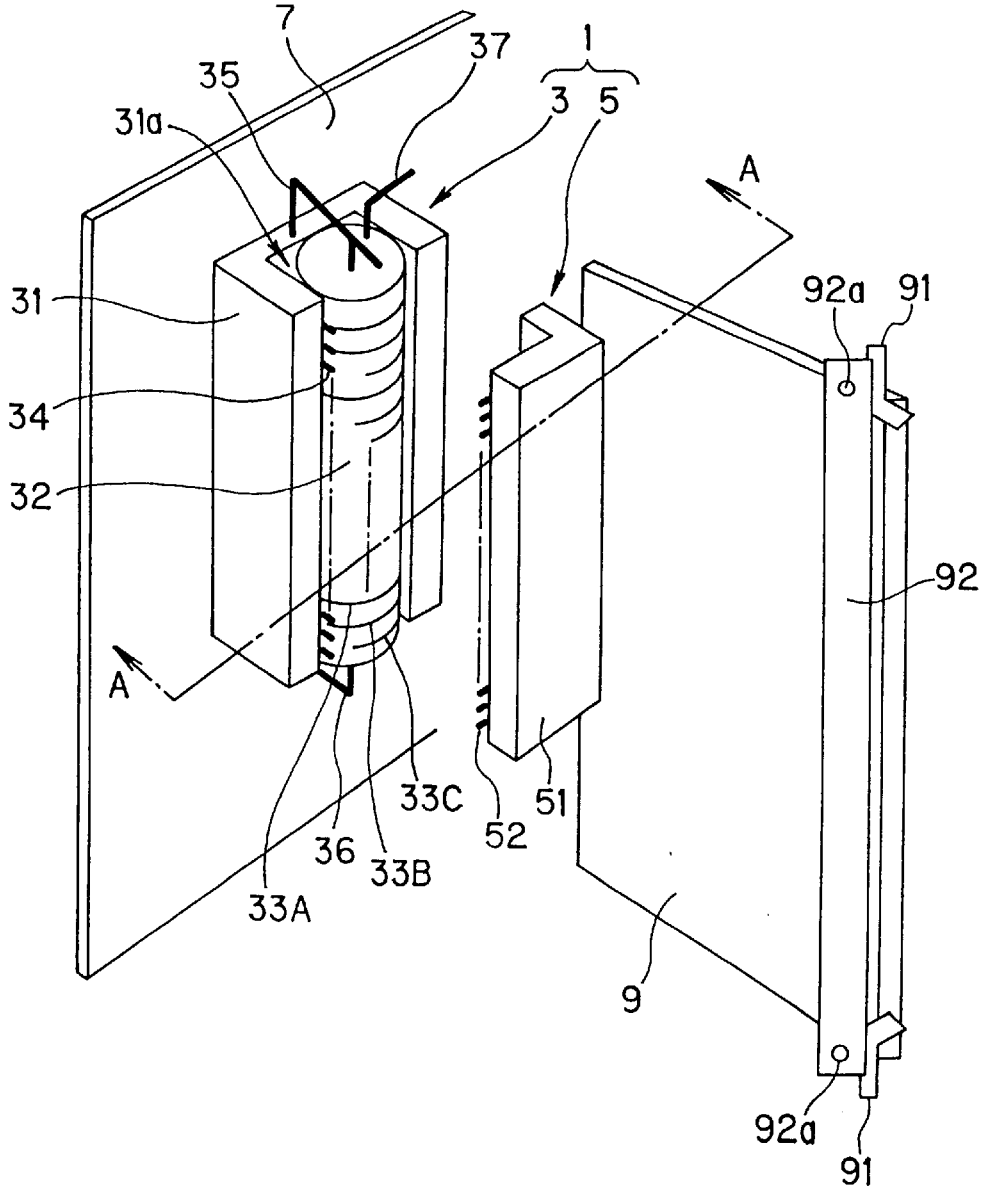
FIG. 1 is a perspective view illustrating a hot pluggable connector according to a first embodiment of the invention.
Figure 2:
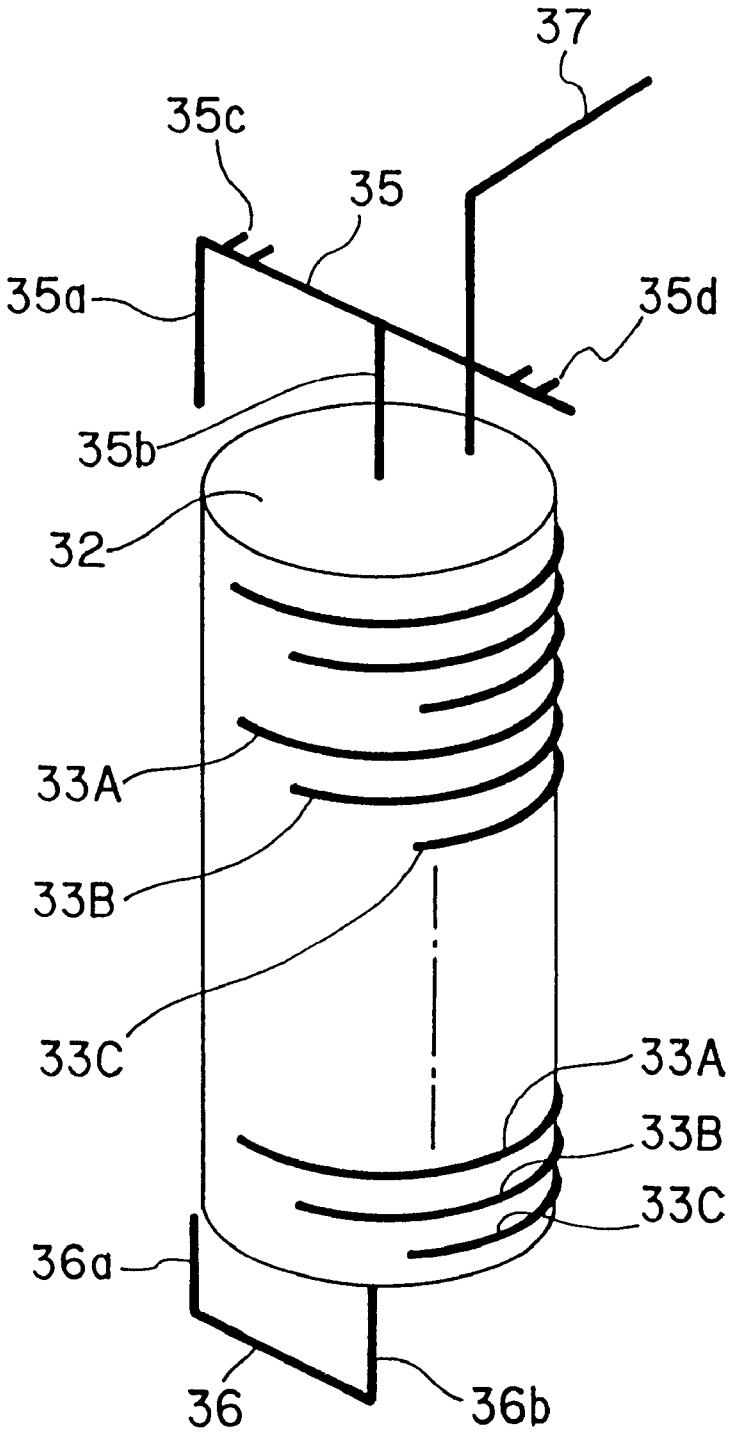
FIG. 2 is a perspective view illustrating a main part of the hot pluggable connector of FIG. 1.
Figure 3A:
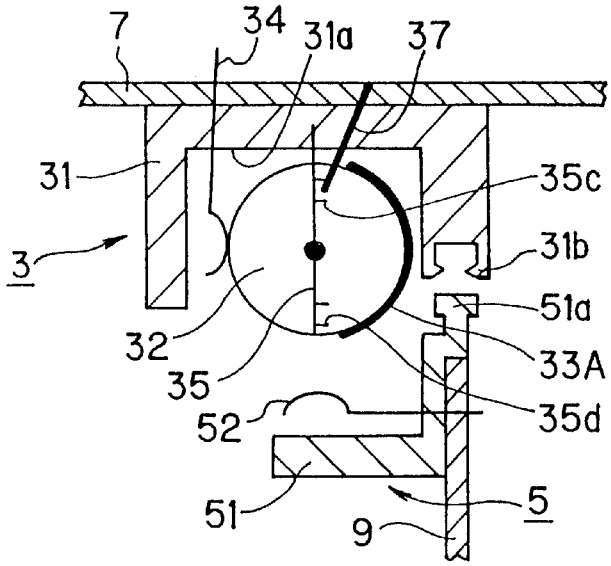
FIG. 3A is a sectional view illustrating a first phase of operation of the hot pluggable connector of FIG. 1.
Figure 3B:
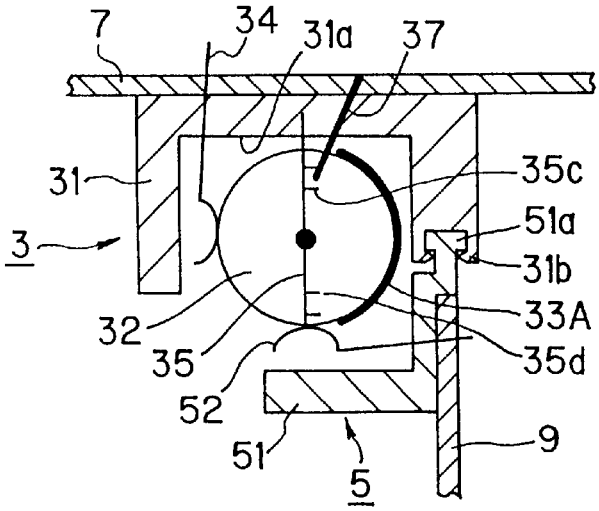
FIG. 3B is a sectional view illustrating a second phase of the operation of the hot pluggable connector of FIG. 1.
Figure 4:
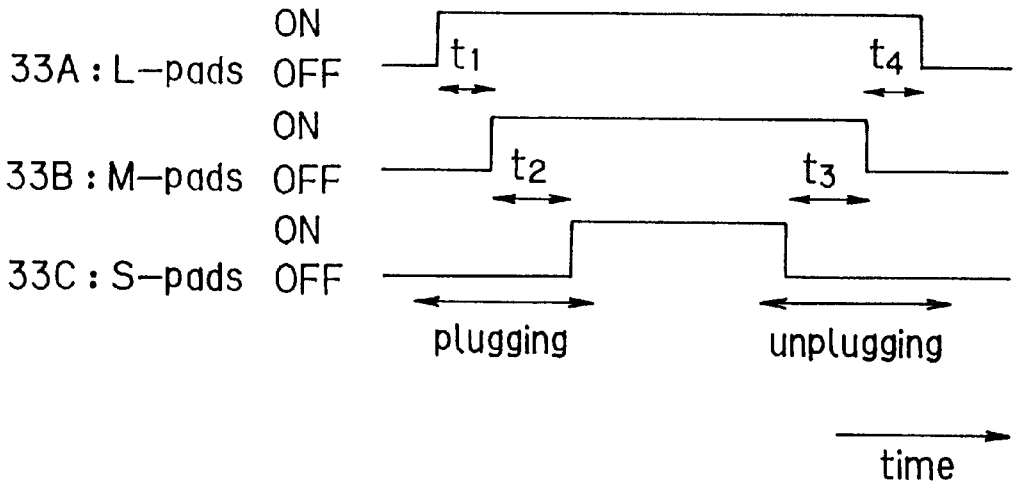
FIG. 4 is a timing chart illustration a connection/disconnection sequence according to rotation of a rotary body of the hot pluggable connector of FIG. 1.

FIG. 1 is a perspective view illustrating a hot pluggable connector according to a first embodiment of the invention, FIG. 2 is a perspective view illustrating a main part of the hot pluggable connector of FIG. 1, FIGS. 3A to 3B are sectional views illustrating operation of the hot pluggable connector of FIG. 1, and FIG. 4 is a timing chart illustration a connection/disconnection sequence according to rotation of a rotary body of the hot pluggable connector of FIG. 1.

Referring to FIGS. 1 to 4, the hot pluggable connector of FIG. 1 has a combination of a board-side connector 3 and a package-side connector 5 to be connected to the board-side connector 3.

The board-side connector 3 provided on a circuit board 7 comprises a board-side housing 31, a rotary body 32, a plurality of pads 33A, 33B and 33C, and the same number of board-side terminals 34.

Figure 3C:
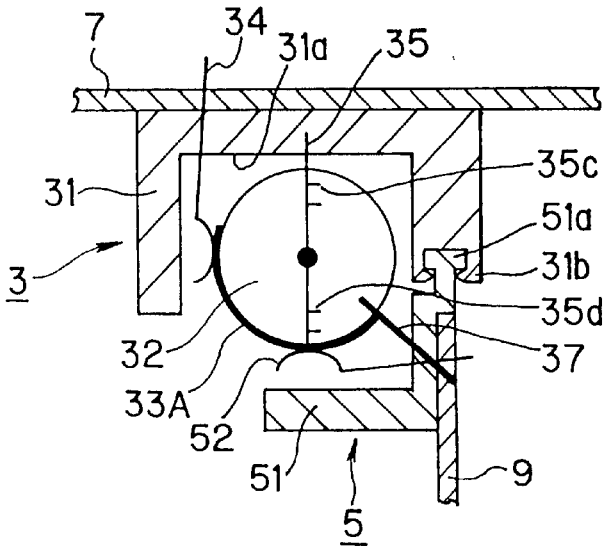
FIG. 3C is a sectional view illustrating a third phase of the operation of the hot pluggable connector of FIG. 1.

As shown in FIG. 1, the board-side housing 31 is fixed to the circuit board 7 and has a quasi-box form with an accommodation concavity 31*a* in which the rotary body 32 is disposed. The board-side housing 31 has also an engagement recess 31*b* formed at an edge of a wall of the board-side housing 31, wherein a package-side housing 51 of the package-side connector 5 is to be engaged, as seen in FIGS. 3A to 3C. Further, the housing 31 is provided with a first and a second support rod 35 and 36. As shown in FIG. 2, the first support rod 35 includes a fixed portion 35*a* which is fixed to the board-side housing 31, a shaft portion 35*b* for supporting one end of the rotary body 32 able to rotate around the shaft portion 35*b*, and hook portions 35*c* and 35*d* whereto a lever 37, which will be described afterwards, is to be engaged.

The second support rod 36 includes a fixed portion 36*a* which is fixed to the board-side housing 31, and a shaft portion 36*b* for supporting the other end of the rotary body 32 able to rotate around the shaft portion 36*b*.

The rotary body 32 is a cylinder having a circular cross-section (along a plane perpendicular to the length thereof). The rotary body 32 is disposed able to rotate arround its own axis in the accommodation concavity 31*a* of the board-side housing 31, supported by the first and the second support rod 35 and 36 fixed to the board-side housing 31. The above-mentioned lever 37 is installed on the rotary body 32 for rotating the rotary body 32. By turning the lever 37 manually, the rotary body 32 is rotated. As shown in FIGS. 3A to 3C, the lever 37 is engaged to the hook portion 35*c* before the rotary body 32 is rotated, and on the hook portion 35*d* after the rotary body 32 is rotated. The rotary body 32 of this example is solid but it may be hollow.

On the circumference of the rotary body 32, there are provided the plurality of pads 33A, 33B and 33C extending in parallel with each other along the rotating direction of the rotary body 32. In the example of FIG. 2, the pads 33A have largest lengths and will be called the "L-pads" hereafter, while the pads 33B and the pads 33C having medium and shortest lengths will be hereafter called the "M-pads" and the "S-pads", respectively.

Each of the board-side terminals 34 having elasticity is fixed inside the board-side housing 31, and connects/disconnects with respective each of the plurality of pads 33A, 33B and 33C, according to rotation of the rotary body 32.

On the other hand, the package-side connector 5, comprising the package-side housing 51 and package-side terminals 52, is mounted on a circuit package 9 having ejectors 91 which are used for joining or disjoining the package-side connector 5 to or from the board-side connector 3, and a panel 92 for reinforcing the circuit package 9 and controlling a cooling air flow of an electronic apparatus (not depicted in the drawings) where the circuit package 9 is installed. In the panel 92, screw holes 92*a* are formed in the upper and lower portions thereof, wherewith the circuit package 9 is screwed onto the electronic apparatus.

The package-side housing 51 having a quasi-L-shaped cross-section is fixed to the circuit package 9 and able to be engaged and disengaged with the board-side housing 31. For the purpose, the package-side housing 51 has an engagement portion 51*a* which is to be engaged with the engagement recess 31*b* of the board-side housing 31. With these engagement portion 51*a* and engagement recess 31*b*, the package-side housing 51 can be easily engaged or disengaged with the board-side housing 31.

Each of the package-side terminals 52 having elasticity is to be connected/disconnected to respective each of the plurality of pads 33A, 33B and 33C, according to rotation of the rotary body 32, when the board-side housing 31 and the package-side housing 51 are engaged with each other.

Now, operation of the first embodiment will be described mainly referring to FIGS. 3A to 3C.

FIG. 3A shows a first phase where the board-side connector 3 and package-side connector 5 are not yet engaged with each other. In this phase, the lever 37 is still fixed to the hook portion 35*c* of the first support rod 35 of the board-side connector 3, and thus, any of the L-pads 33A, the M-pads 33B and the S-pads 33C is left not in contact with the board-side terminals 34. As above mentioned, the board-side terminals 34 have elasticity, with which they are always kept in contact with the circumference of the rotary body 32.

FIG. 3B shows a second phase where the board-side connector 3 and package-side connector 5 are engaged with each other after the circuit package 9 is inserted into the electronic apparatus. The circuit package 9 is plugged in making use of the ejectors 91, and the package-side connector 5 and the board-side connector 3 are fixed to each other by the engagement portion 51*a* of the package-side connector 5 engaging into the engagement recess 31*b* of the board-side connector 3. The package-side terminals 52 also become in contact with the circumference of the rotary body 32 by their elasticity when the package-side connector 5 and board-side connector 3 are once engaged. Further, making use of bolts (not depicted in the drawings) screwed into the screw holes 92*a* of the panel 92, the circuit package 9 can be securely fixed to the electronic apparatus in order to prevent the package 9 loosing off from the electronic apparatus and the package-side terminals 52 can be kept as well in contact with the circumference of the rotary body 32. In this phase, any of the L-pads 33A, the M-pads 33B and the S-pads 33C is not yet in contact with any of the board-side and the package-side terminals 34 and 52.

FIG. 3C shows a third phase wherein each of the board-side terminals 34 is being connected to respective each of the package-side terminals 52 sequentially one by one according to rotation of the rotary body 32, by way of each of the L-pads 33A, the M-pads 33B and the S-pads 33C.

By manually releasing the lever 37 from the hook portion 35*c* from the first support rod 35 and then turning it clockwise with the rotary body 32 as illustrated in FIG. 3C, the L-pads 33A, longest of the three pad groups, are put into contact with corresponding ones of the package-side terminals 52. Thereafter, the M-pads 33B and then the S-pads 33C are put into contact with corresponding ones of the package-side terminals 52, respectively. As the rotary body 32 is further rotated, the L-pads 33A are first put into contact with corresponding ones of the board-side terminals 34. Namely, each of the board-side terminals 34 of a first group is electrically connected to the respective each of the package connector terminals 52 by means of corresponding one of the L-pads 33A at this timing. Thereafter, such a connection is made between the board and package connector terminals 34 and 52 by means of each of the M-pads 33B and the S-pads 33C, sequentially in this order. Finally, the rotary body 32 is stopped from rotating by manually engaging the lever 37 onto the hook portion 35*d* of the first support rod 35.

FIG. 4 shows the sequence of such connections between the board-side and the package-side terminals 34 and 52. As seen in the timing chart of FIG. 4, when the package-side connector 5 is coupled to the board-side connector 3, the terminals 52 are electrically connected to the terminals 34 group by group by means of the L-pads 33A, the M-pads 33B and the S-pads 33C, sequentially in this order with time differences t1 and t2, respectively. When the package-side connector 5 is to be disconnected from the board-side connector 3, the connections between the terminals 34 and 52 made by the S-pads 33C, the M-pads 33B and the L-pads 33A are cut sequentially in this order with time differences t3 and t4, respectively. These time differences t1 and t2 or the time differences t3 and t4 can be set optionally by changing pad lengths of the rotary body 32, or by changing rotation speed of the rotary body 32. Therefore, by assigning the L-pads 33A to ground connections, the M-pads 33B to power supply connections and the S-pads 33C to signal connections, respectively, for instance, it is possible to prevent the supply voltage variation or the bus-like signal disturbance being caused by hot plugging or unplugging of the circuit package 9.

For unplugging the circuit package 9 from the circuit board 7, the lever 37 is disengaged from the hook portion 35*d* of the first support rod 35 and the rotary body 32 is rotated counterclockwise to the initial position thereof by turning the lever 37 reversely.

As heretofore described, the sequential connection/disconnection between the board-side terminals 34 and the package-side terminals 52 is realized by way of the plurality of pads 33A to 33C according to rotary movement of the rotary body 32. Therefore, it is not necessary to plug or unplug the circuit package 9 within a time limit, and hence, the shock accompanying the high-speed plugging or unplugging of the circuit package 9 can be eliminated, which makes it unnecessary to provide reinforcing mechanism against such shocks to either the circuit board 7 or the circuit package 9, and improves reliability of the circuit board 7 by preventing damages to the wiring pattern and degradation of the circuit element thereof.

Furthermore, the connection/disconnection sequences such as represented by the time differences t1 and t2 or the time differences t3 and t4 can be optionally set by only arranging pad length of the rotary body 32. Therefore, the hot pluggable connector according to the embodiment can be manufactured with a lower cost, than the conventional hot pluggable connector wherein the terminal length should be correspondingly changed, if the sequence of terminal connections has to be changed, resulting in a high manufacturing cost.

Furthermore, since the board-side and the package-side terminals 34 and 52 are put into contact with the pads 33A, 33B and 33C according to the rotary movement of the rotary body 32 performed by turning the lever 37, the leverage force necessary for connecting the terminals to the pads is very small as compared with that necessary for plugging or unplugging the conventional hot pluggable connector.

Still further, as the rotary body 32 is rotated, it will effectively clean the surfaces of the pads and terminals, by wiping.

Heretofore, the embodiment is described to have the three kinds of pad length (the L-pads 33A, the M-pads 33B and the S-pads 33C on the rotary body 32). However, more kinds of pad lengths may of course be employed for providing a desired number of stages of the sequential connection/disconnection.

In the following paragraphs, a hot pluggable connector according to a second embodiment of the invention will be described referring to FIGS. 5 to 7.

Figure 5:
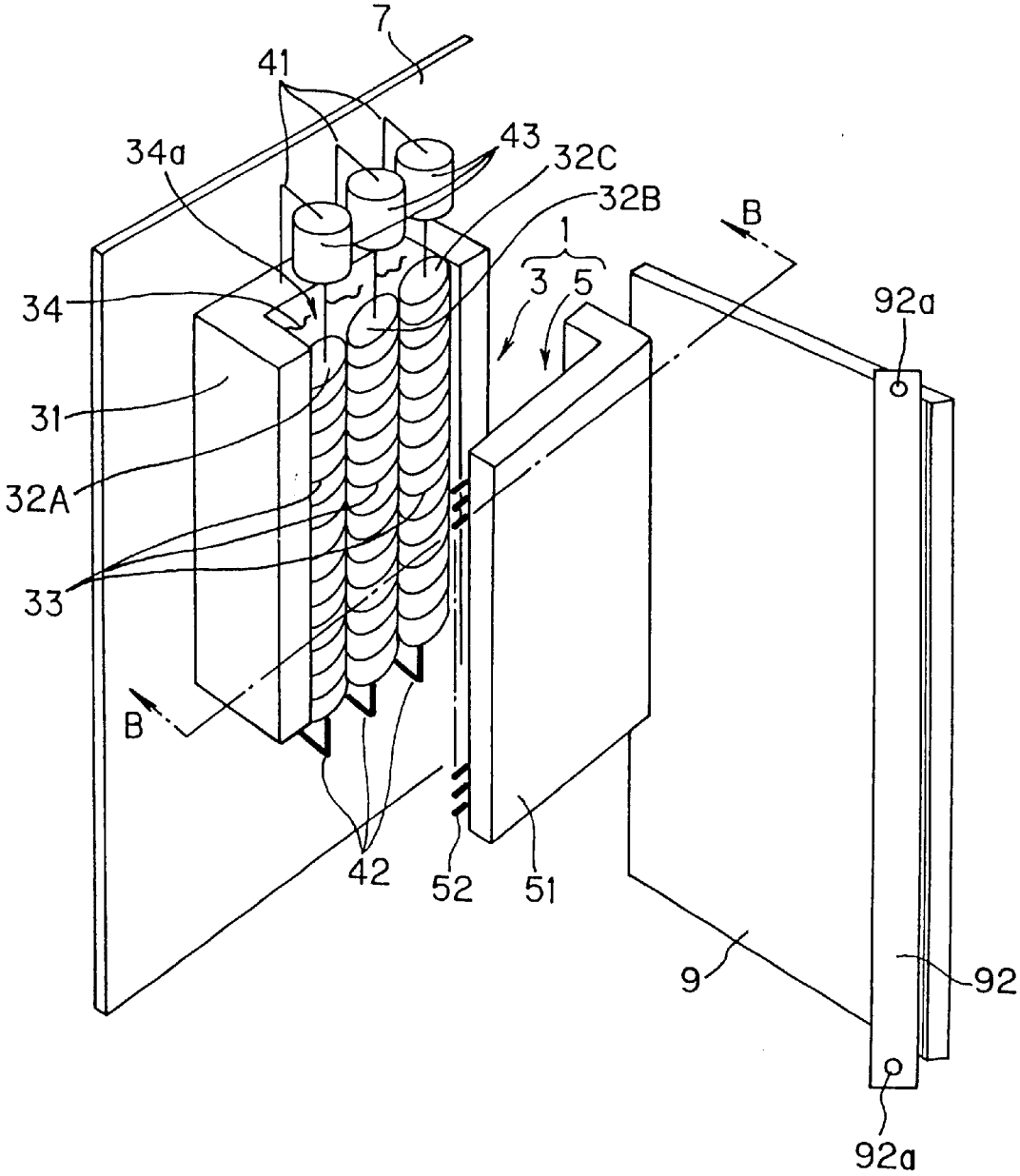
FIG. 5 is a perspective view illustrating a hot pluggable connector according to a second embodiment.
Figure 6:
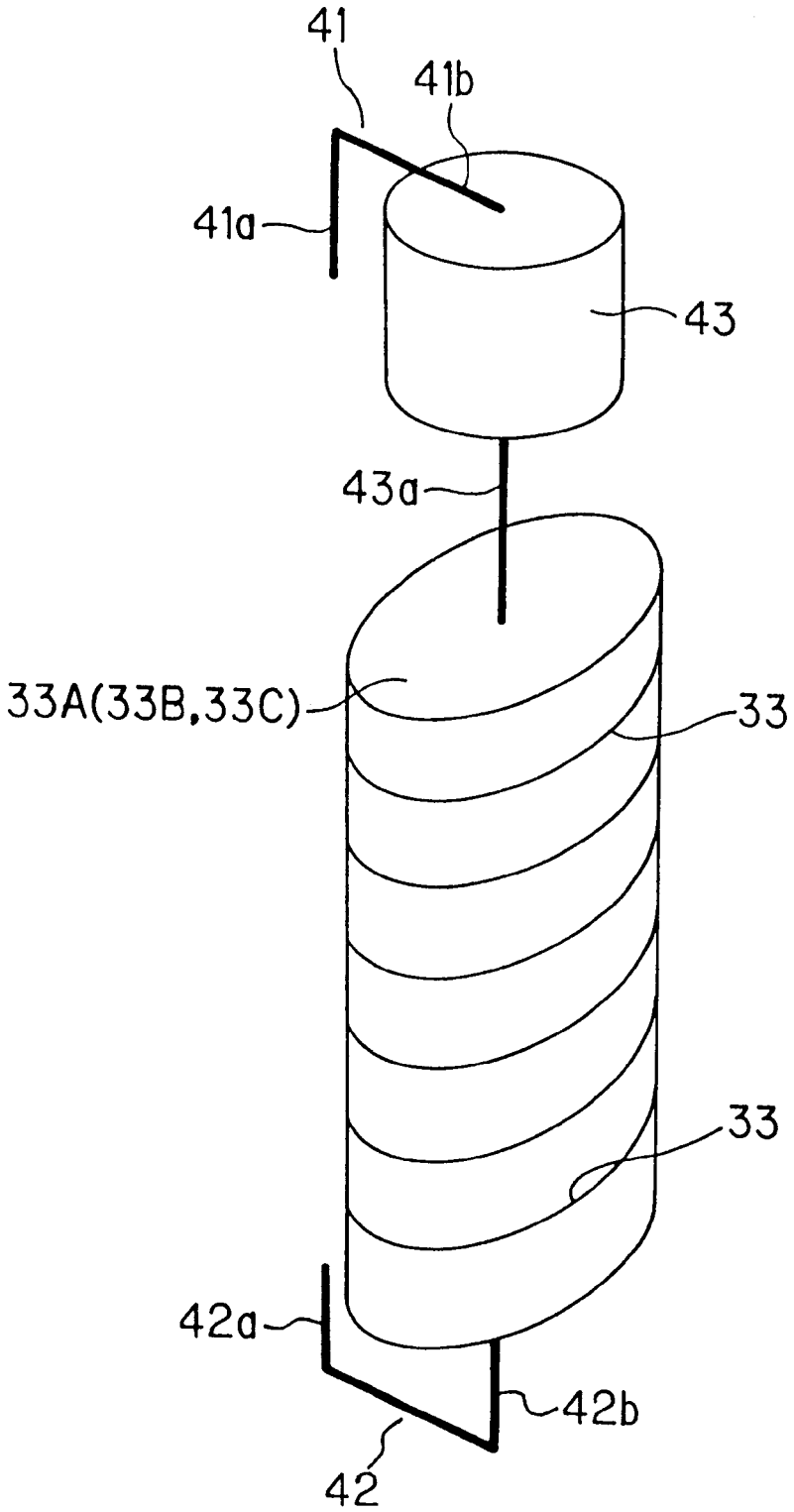
FIG. 6 is a perspective view illustrating a main part of the hot pluggable connector of FIG. 5.

FIG. 5 is a perspective view illustrating the hot pluggable connector according to the second embodiment, FIG. 6 is a perspective view illustrating a main part of the hot pluggable connector of FIG. 5, and FIGS. 7A to 7C are sectional views illustrating operation of the hot pluggable connector of FIG. 5.

The hot pluggable connector 1 of the second embodiment has a combination of a board-side connector 3 and a package-side connector 5 to be connected to the board-side connector 3.

The board-side connector 3 provided on a circuit board 7 comprises a board-side housing 31, three rotary bodies 32A to 32C, a plurality of pads 33, and the same number of board-side terminals 34.

Figure 7A:
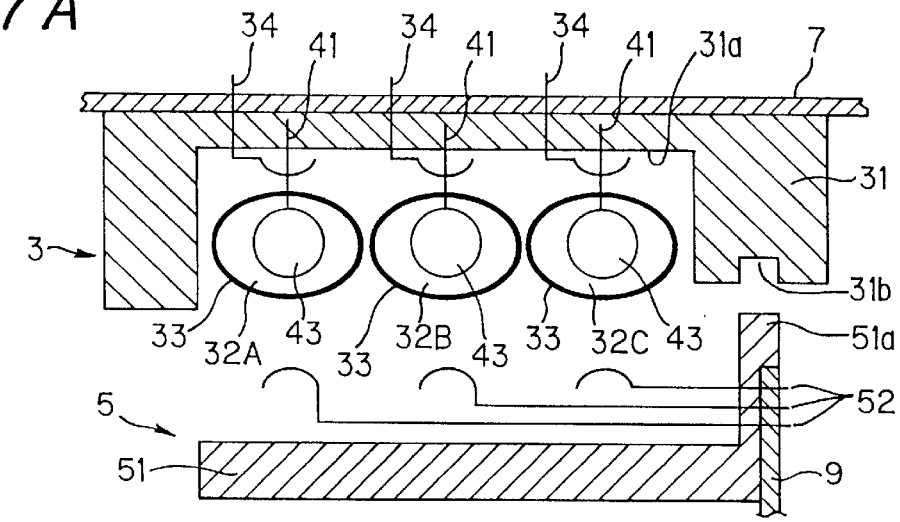
FIG. 7A is a sectional view illustrating a first phase of operation of the hot pluggable connector of FIG. 5.
Figure 7B:
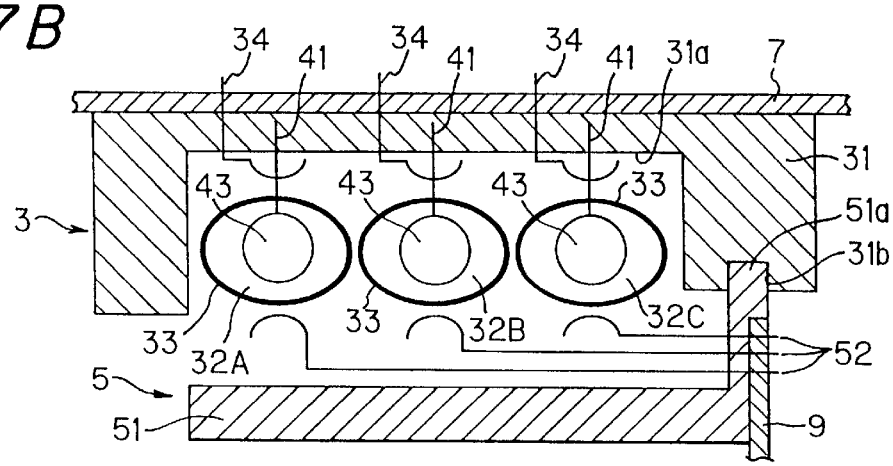
FIG. 7B is a sectional view illustrating a second phase of the operation of the hot pluggable connector of FIG. 5.
Figure 7C:
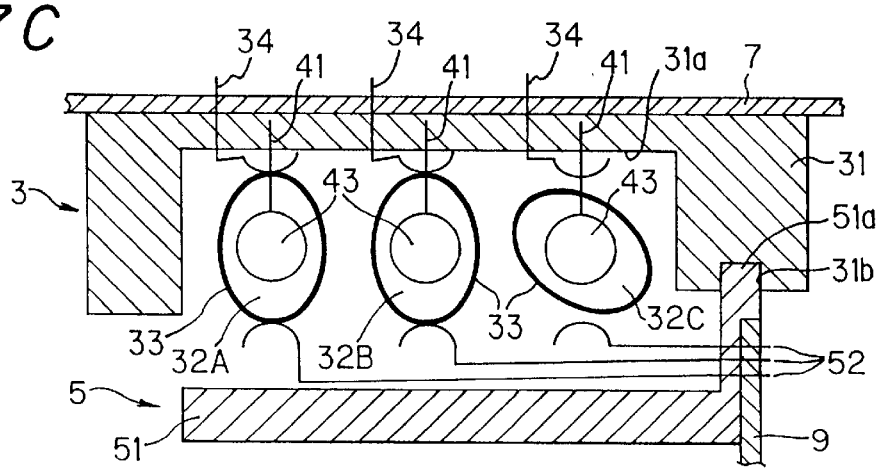
FIG. 7C is a sectional view illustrating a third phase of the operation of the hot pluggable connector of FIG. 5.
Figure 8:
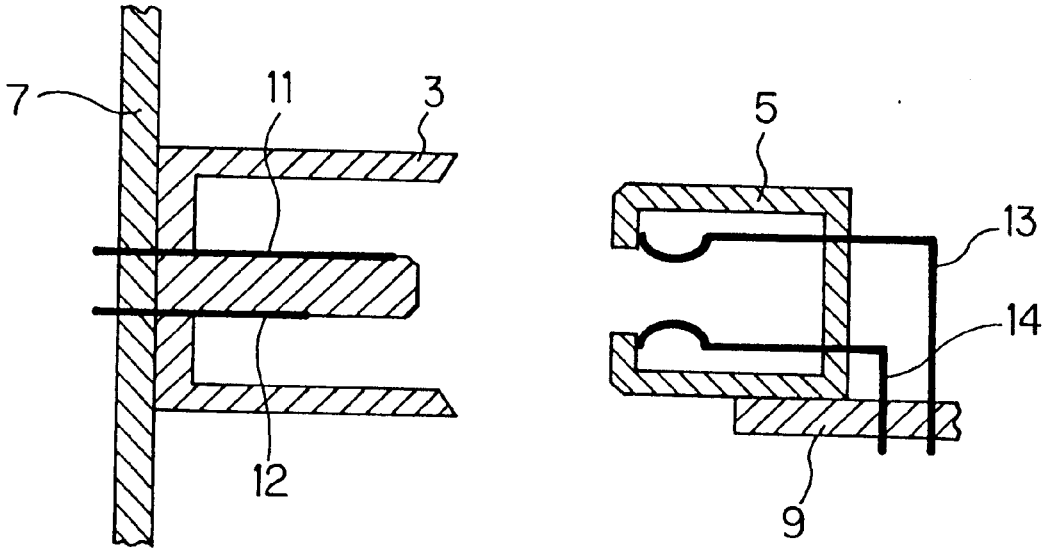
FIG. 8 PRIOR ART
FIG. 8 is a sectional view of a conventional hot pluggable connector.
Figure 9:
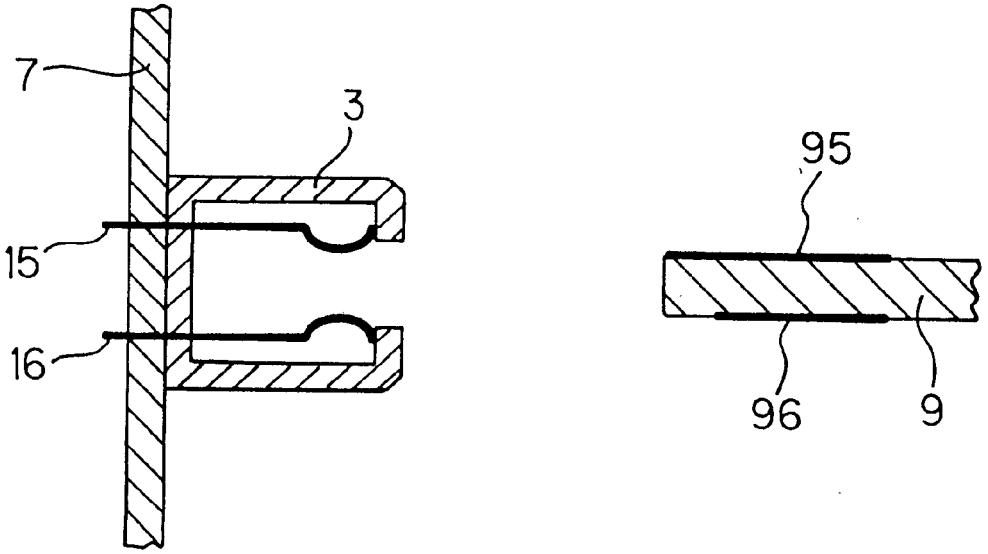
FIG. 9 PRIOR ART
FIG. 9 is a sectional view of another type of conventional hot pluggable connector.

As shown in FIG. 5, the board-side housing 31 is fixed to the circuit board 7 and has a quasi-box form with an accommodation concavity 31*a* in which the three rotary bodies 32A to 32C are disposed. The board-side housing 31 has also an engagement recess 31*b* formed at an edge of a wall of the board-side housing 31, wherein a package-side housing 51 of the package-side connector 5 is to be engaged, as seen in FIGS. 7A to 7C. Further, the housing 31 is provided with three pairs of a first and a second support rod 41 and 42. As shown in FIG. 6, each of the first support rods 41 includes a fixed portion 41*a* which is fixed to the board-side housing 31, and a support portion 41*b* for supporting each of three motors 43.

Each of the second support rods 42 includes a fixed portion 42*a* which is fixed to the board-side housing 31, and a shaft portion 42*b* for supporting each of the three rotary bodies 32A to 32C able to rotate arround the shaft portion 42*b*.

Each of the rotary bodies 32A to 32C has the same cylindrical form with an elliptic cross-section taken along a plane perpendicular to a longitudinal direction thereof. They are disposed able to rotate around their respective longitudinal center lines in the accommodation concavity 31*a* of the housing 31. One end of each of the rotary bodies 32A, 32B and 32C is coupled to a drive shaft 43*a* of each of the motors 43 each supported by respective each of the first support rods 41 fixed to the housing 31. The other end of each of the rotary bodies 32A, 32B and 32C is supported by the shaft portion 42*b* of respective each of the second support rods 42, able to rotate arround the shaft portion 42*b*. Each of the rotary bodies 32A, 32B and 32C is driven by respective each of the motors 43, independently from each other.

In this example, the rotary bodies 32A, 32B and 32C are described to be solid cylinders. However, they may be hollow cylinders, or they may not necessarily be cylindrical. Also, the cross-sections of the rotary bodies 32A, 32B and 32C are described to be elliptic in the example. However, the cross-sectional shape of the rotary bodies is not limited to the elliptic form, on condition that the cross-sectional shape perpendicular to the rotary axis of the rotary bodies is not a circle having a center where the rotary axis intersects the cross-sectional shape.

Each of the plurality of pads 33 is so formed to round circumference of one of the rotary bodies 32A, 32B and 32C, in parallel to each other in a rotary direction of the rotary bodies, and each of the board-side terminals 34 having elasticity is arranged inside the board-side housing 31 so as to connect with each of the plurality of pads 33, respectively, according to rotation of corresponding one of the three rotary bodies 32A, 32B and 32C.

On the other hand, the package-side connector 5, comprising the package-side housing 51 and package-side terminals 52, is mounted on the circuit package 9 having similar configuration with the circuit package 9 of FIG. 1.

The package-side housing 51 having a quasi-L-shaped cross-section is fixed to the circuit package 9 and able to be engaged and disengaged with the board-side housing 31. For the purpose, the package-side housing 51 has an engagement portion 51*a* which is to be engaged with the engagement recess 31*b* of the board-side housing 31. With these engagement portion 51*a* and engagement recess 31*b,* the package-side housing 51 can be easily engaged or disengaged with the board-side housing 31.

Each of the package-side terminals 52 having elasticity is so arranged as to be connected/disconnected to respective each of the plurality of pads 33, according to rotation of corresponding one of the rotary bodies 32A to 32C, when the board-side housing 31 and the package-side housing 51 are engaged with each other.

Now, operation of the first embodiment will be described mainly referring to FIGS. 7A to 7C.

FIG. 7A shows a first phase where the board-side connector 3 and package-side connector 5 are not yet engaged with each other. In this phase, none of the plurality of pads 33 is in contact with any of the board-side terminals 34 and the package-side terminals 52.

FIG. 7B shows a second phase where the board-side connector 3 and package-side connector 5 are engaged with each other after the circuit package 9 is inserted into the electronic apparatus. In this phase, the package-side terminals 52 are not yet in contact with any of the rotary bodies, no contact pressure being needed. Further, for engaging the board-side connector 3 with the package-side connector 5, it is sufficient to insert the engagement portion 51*a* of the package-side connector 5 in the engagement recess 31*b* of the board-side connector 3. Therefore, little force is required for plugging the circuit package 9 into the board-side connector 3.

Making use of bolts (not depicted in the drawings) screwed into the screw holes 92*a* in the panel 92, the circuit package 9 is fixed to the electronic apparatus in order to prevent the package 9 loosing off from the electronic apparatus. In this phase, any of the plurality of pads 33 is not yet in contact with any of the board-side and the package-side terminals 34 and 52.

FIG. 7C shows a third phase wherein each of the board-side terminals 34 is being connected to respective each of the package-side terminals 52 sequentially group by group according to rotation of each of the rotary bodies 32A to 32C, by way of each of the plurality of pads 33.

Each of the motors 43 is started by manually or controlled by software, sequentially with a time difference. When the rotary body 32A is rotated by 90°, for example, the pads 33 of the rotary body 32A become in contact with the board-side terminals 34 and the package-side terminals 52, and consequently, each of corresponding certain of the board-side terminals 34 is connected electrically to corresponding each of the package-side terminals 52 by way of each of the pads of the rotary body 32A. At this timing, contact pressure begins to work between the board-side terminals 34 and the pads 33 and between the pads 33 and the package-side terminals 52.

By turning the rotary body 32B and 32C sequentially in the same way, the board-side terminals 34 and the package-side terminals 52 are connected electrically by way of the pads 33 of each of the rotary bodies 32B and 32C.

For unplugging the circuit package 9 from the circuit board 7, the above procedure may be reversely followed.

In addition to the merits of the first embodiment, the second embodiment has a merit that the circuit package 9 can be inserted or removed with little force because of the elliptic cross-sectional shape of the rotary bodies which remain not in contact with terminals when the circuit package 9 is inserted or removed.

In conventional hot pluggable connectors, a larger force is required for plugging or unplugging a connector as the number of terminals to be connected increases. According to the second embodiment, however, three rotary bodies are rotated one by one, thereby permitting to reduce the force necessary to put the board-side terminals 34 and package-side terminals 52 into contact with each other.

Heretofore, the second embodiment is described in connection with the example having three rotary bodies 32A to 32C for realizing a sequential connection/disconnection of three stages. However, it goes without saying that more number of stages of sequential connection/disconnection can be realized by providing more number of rotary bodies, further reducing the force required for turning each of the rotary bodies.

What is claimed is:

1. A hot pluggable connector having a combination of a board-side connector and a package-side connector to be connected to the board-side connector, said board-side connector comprising:

a board-side housing fixed to a circuit board;

a rotary body disposed inside the board-side housing, said rotary body having a circular cross-section and being able to rotate around an axis thereof;

a plurality of pads of a plurality of lengths, each of the plurality of pads extending along a circumference of the rotary body and in parallel to each other in a rotating direction of the rotary body; and board-side terminals, each provided inside the board-side housing to be connected with at least a corresponding one of the plurality of pads according to rotation of the rotary body; and said package-side connector comprising:

a package-side housing fixed to a circuit package and able to be engaged and disengaged with the board-side housing; and package-side terminals, each provided inside the package-side housing to be connected with at least a corresponding one of the plurality of pads according to rotation of the rotary body when the package-side housing is engaged with the board-side housing.

2. A hot pluggable connector as recited in claim 1, wherein the rotary body is provided with a lever extending in a radial direction of the rotary body for rotating the rotary body.

3. A hot pluggable connector having a combination of a board-side connector and a package-side connector to be connected to the board-side connector, said board-side connector comprising:

a board-side housing fixed to a circuit board;

at least two rotary bodies disposed inside the board-side housing, each of said rotary bodies being able to rotate around an axis thereof independently from each other, and having a cross-section, perpendicular to the axis, of a form other than a circle having a center where the axis intersects the cross-section;

a plurality of pads provided on each of the rotary bodies, each rounding circumference of the rotary bodies arranged in parallel to each other in a rotating direction of said one of the rotary bodies; and board-side terminals, each provided inside the board-side housing to be connected with at least a corresponding one of the plurality of pads according to rotation of a corresponding one of the rotary bodies; and said package-side connector comprising:

a package-side housing fixed to a circuit package and able to be engaged and disengaged with the board-side housing; and package-side terminals, each provided inside the package-side housing to be connected with a corresponding one of the plurality of pads according to rotation of the corresponding one of the rotary bodies when the package-side housing is engaged with the board-side housing.

4. A hot pluggable connector as recited in claim 3, wherein each of the rotary bodies is formed like a cylinder.

5. A hot pluggable connector as recited in claim 4, wherein each of the rotary bodies has an elliptic cross-section perpendicular to the axis.

6. A hot pluggable connector as recited in claim 3, further comprising a plurality of motors, each for rotating a respective one of the rotary bodies.

7. A hot pluggable connector as recited in claim 2, the board-side connector further comprising:

a first support rod having a fixed portion fixed to the board-side housing, a shaft portion supporting a first end of the rotary body and a hook portion; and a second support rod having a fixed portion fixed to the board-side housing, and a shaft portion for supporting a second end of the rotary body.

8. A hot pluggable connector as recited in claim 7, wherein the lever engages with part of the hook portion to prevent further rotation of the rotary body.

9. A hot pluggable connector as recited in claim 6, wherein the board-side connector further comprises:

a plurality of first support rods, each including a first fixed portion fixed to the board-side housing and a support portion for supporting each motor; and a plurality of second support rods, each including a second fixed portion fixed to the board-side housing, and a shaft portion for supporting the respective rotary body.

10. A hot pluggable connector as recited in claim 9, wherein the board-side connector further comprises a plurality of drive shafts, each of which is connected between a respective motor and a respective rotary body.

11. A hot pluggable connector having a board-side connector and a package-side connector; said board-side connector comprising:

a board-side housing;

a rotary body disposed inside the board-side housing, said rotary body having a circular cross-section and being able to rotate around an axis thereof;

a plurality of pads each being of a different length, each of the plurality of pads extending along a circumference of the rotary body and in parallel to each other in a rotating direction of the rotary body; and board-side terminals each connectable with at least a corresponding one of the plurality of pads based on the rotation of the rotary body.

12. A hot pluggable connector as recited in claim 11, wherein said package-side connector comprises:

a package-side housing able to be engaged and disengaged with the board-side housing; and package-side terminals, connectable with at least a corresponding one of the plurality of pads based on rotation of the rotary body.

13. A hot pluggable connector as recited in claim 11, wherein the rotary body is provided with a lever extending in a radial direction of the rotary body for rotating the rotary body.

14. A hot pluggable connector as recited in claim 13, the board-side connector further comprising:

a first support rod having a fixed portion fixed to the board-side housing, a shaft portion supporting a first end of the rotary body and a hook portion; and a second support rod having a fixed portion fixed to the board-side housing, and a shaft portion for supporting a second end of the rotary body.

15. A hot pluggable connector as recited in claim 14, wherein the lever engages with part of the hook portion to prevent further rotation of the rotary body.

* * * * *